United States Patent [19]

Traut et al.

[11] Patent Number: 4,647,940

[45] Date of Patent: Mar. 3, 1987

[54] PARALLEL PLATE WAVEGUIDE ANTENNA

[75] Inventors: G. Robert Traut, Danielson; Geoff J. Wilson, Rogers, both of Conn.

[73] Assignee: Rogers Corporation, Rogers, Conn.

[21] Appl. No.: 424,836

[22] Filed: Sep. 27, 1982

[51] Int. Cl.[4] ..... H01Q 13/18

[52] U.S. Cl. ..... 343/770; 343/785

[58] Field of Search ..... 343/770, 785, 767, 769, 343/771

[56] References Cited

U.S. PATENT DOCUMENTS

| | | | |
|---|---|---|---|
| 3,032,762 | 5/1962 | Kerr | 343/775 |
| 4,160,976 | 7/1979 | Conroy | 343/700 MS |
| 4,218,682 | 8/1980 | Yu | 343/700 MS |
| 4,366,484 | 12/1982 | Weiss et al. | 343/700 MS |
| 4,415,900 | 11/1983 | Kaloi | 343/700 MS |

*Primary Examiner*—Eli Lieberman
*Assistant Examiner*—K. Ohralik
*Attorney, Agent, or Firm*—Fishman & Dionne

[57] ABSTRACT

A parallel plate waveguide microwave antenna is presented in which transmission or reception of microwave energy is effected by radiating waveguide slots or apertures in a metallized glass plate or plate of other rigid dielectric material. The metallized glass plate cooperates with another metallized glass plate or other rigid dielectric material or a metal plate to define a parallel plate waveguide with air or an inert gas or vacuum as the dielectric between the plates. When used as a transmitter antenna, a central electrode propagates waves in the dielectric medium in expanding circles; and the slots or apertures in the metal layer act as scattering sites to couple the waves to free space. When used as a receiver antenna, the reverse will occur.

17 Claims, 1 Drawing Figure

PARALLEL PLATE WAVEGUIDE ANTENNA

BACKGROUND OF THE INVENTION

This invention relates to the field of microwave antennas. More particularly, this invention relates to a parallel plate waveguide antenna for use as a transmitter antenna or receiver antenna primarily for broadcasted microwave signals for TV systems. While this invention may have general utility in microwave transmission or reception, the invention will be described in the preferred environment of a direct satellite broadcasting (DSB) system. However, it will be understood that the invention may have general utility as either a receiver antenna or transmitter antenna in microwave communication systems.

With the growing potential for satellite transmission of microwave signals for TV broadcasting and receiving systems, there is an increasing need for a reliable, durable and reasonably inexpensive antenna for household and other commercial use for the reception of satellite transmitted microwave signals. Parabolic antennas are traditionally used in transmission systems of this type, but they present many problems for an effective and commercially viable TV microwave reception system. Among other problems, parabolic antennas are relatively expensive, and are not sufficiently stable in low winds to guarantee consistent signal reception and hence picture quality. Thus, they are not particularly suitable for everyday use in home or other commercial TV reception systems.

Stripline or microstrip antennas for microwave transmission or reception are known in the art. Such antennas are shown, for example, in UK Pat. No. 1,529,361 to James and Wilson, U.S. Pat. Nos. 3,995,277 to M. Olyphant, Jr., 3,987,455 to M. Olyphant, Jr. and 3,803,623 to L. Scharlot, Jr. In all of these prior patents the antenna structure consists of a laminate structure of a dielectric material with an electrically conductive ground plane on one surface of the dielectric and a stripline or microstrip pattern on the other surface of the dielectric. It is well known that the properties of the dielectric material are important to the performance of the antenna, especially the properties of dielectric constant and dissipation factor. Those considerations make these conventional microstrip antennas practicably unsuitable for TV receiver only (TVRO) antennas because they severely limit the choice of suitable dielectric materials to very expensive materials, especially when one considers that a TVRO antenna must be relatively large, such as on the order of a square structure 30 to 40 inches on each side or a circular structure having a diameter of 30 to 40 inches. Also, since TVRO antennas will be used outdoors, they must be weatherized to protect them from exposure to the elements. This is particularly so with the conventional prior art stripline or microstrip antennas where the circuit pattern and the ground plane are on the exterior of the dielectric surfaces. This weatherizing requirement further adds to the economic and practical problems of using prior art microstrip antennas in TVRO systems.

The combined requirements of electrical properties and weathering resistance limit the choice of dielectric materials that may be effectively employed in a practicable TVRO antenna if one were constructed in accordance with conventional prior art techniques. The combined requirements of electrical properties and weathering resistance limits the choice of dielectric materials.

Low loss ceramics would offer good performance for the dielectric material, but the cost and limited size of ceramic substrates would rule them out. PTFE (polytetrafluoroethylene) based substrates or substrates based on other fluoropolymers would also be acceptable choices from the standpoint of dielectric properties, but the cost of such substrates would make them unsuitable for home and general commercial use. Thus, because of the economic and other practical drawbacks, the art has not developed a commercially practicable and acceptable planar TVRO antenna.

The microstrip antennas disclosed in the previsously mentioned UK Pat. No. 1,529,361 and U.S. Pat. Nos. 3,995,277, 3,987,455 and 3,803,623 may be described, in general terms, as having a dielectric body with a ground plane on one surface and a radiator pattern on the other surface. It is known that antennas of this type can experience a problem of surface waves which are generated at the boundaries of the dielectric support for the radiator and air. These surface waves will travel between radiators and constitute a power loss in the system and impair the quality of beam formation.

SUMMARY OF THE INVENTION

The above-discussed and other problems of the prior art are overcome or reduced by the antenna of the present invention. It is expected that the antenna of the present invention will find practical application primarily as a receiving antenna in a direct satellite broadcasting system. However, because of the reciprocal nature of microwave antennas, the antenna of the present invention may be used either as a transmitter antenna or as a receiver antenna. Furthermore, because explanation of the operation of the antenna of the present invention is more convenient when discussing operation in the transmission mode, the antenna will be discussed from the standpoint of the transmission mode; but it will, however, be understood that the antenna is expected primarily to be used as a receiver, with the receiver mode being a reciprocal of the transmission mode.

In accordance with the present invention, a parallel plate waveguide microwave antenna is composed of a pair of spaced apart plates separated by a dielectric of air, inert gas or vacuum. One plate (which will be referred to as the upper or radiator plate) is a plate of any rigid dielectric material, preferrably glass, with a metallized layer on the inner surface. The second plate (which will be referred to as the lower or ground plate) may also be a metallized glass or other rigid dielectric material plate or other metallized or metal surface. The metallized surface of the first plate faces and is spaced from the metallized surface of the second plate. The two plates with the dielectric medium confined therebetween constitute a parallel plate waveguide. The metallized surface of the first plate defines a series of radiating waveguide slots or apertures in the parallel plate waveguide structure for radiating a beam into free space. A central electrode, sometimes referred to as a launch electrode, and which may be the center conductor of a coaxial cable, is located between the plates and establishes transition between the waveguide energy and a coaxial or waveguide transmission line. The metallized surface of the first plate is not directly connected to the coaxial or waveguide transmission line; the second plate is directly connected to the coaxial or waveguide transmission line.

Microwave signals are converted to waves propagating outwardly in the dielectric as expanding circles from the launch electrode toward the outer edge of the parallel plate waveguide. When the expanding circular waves in the waveguide encounter the waveguide slots or apertures, they are coupled to free space in a beam by radiation at the slots or apertures. The signals are thus radiated to free space where they may be received by a similar reciprocal antenna located at a receiver station.

BRIEF DESCRIPTION OF THE DRAWINGS

Referring to the drawing, the single figure is a sectional elevational view of an antenna constructed in accordance with the present invention.

DESCRIPTION OF THE PREFERRED EMBODIMENT

Figure 1:
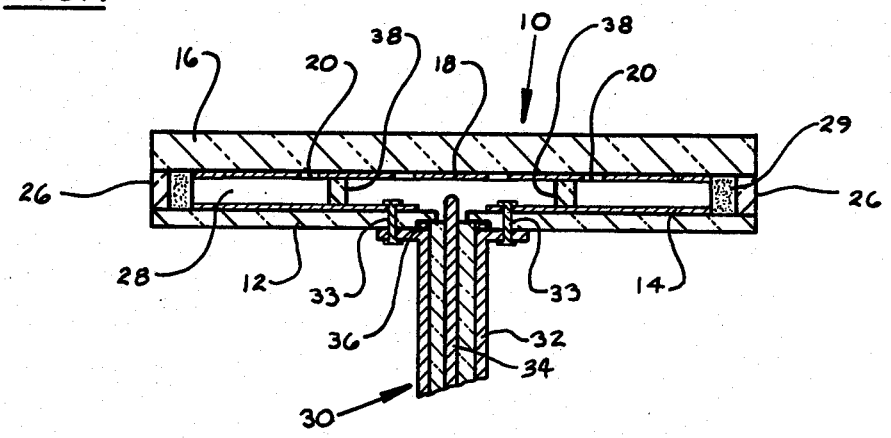

The preferred embodiment of the present invention uses glass as a base or substrate material for both the ground plane and the radiator plate of a parallel plate antenna. As the term "glass" is used in this invention, it will be understood to mean and include any amorphous inorganic transparent or translucent substance formed by fusion of sand, silica or other materials to produce a mass that cools to a rigid condition without crystallization, or any of the various inorganic or organic substances resembling glass in transparency, hardness and amorphous nature, as long as the material has the appropriate dielectric characteristics to make it suitable for use as a TVRO antenna.

The parallel plate antenna 10, (which is preferrably circular in top plan section) has a lower glass plate or base 12 which carries a single monolithic ground plane 14. The antenna also has an upper glass plate 16 which carries a metallized pattern of material 18 with openings or apertures 20 which constitutes a predetermined pattern of radiating waveguide slots or apertures of the microwave antenna. The pattern of radiating waveguide slots or apertures 19 will be arrayed and the slots will be shaped, so as to radiate a desired beam.

Both ground plane 14 and metallized layer 18 are bonded or adhered to their respective glass plates 12 and 16 by any suitable or convenient method. Ground plane 14 and radiator pattern layer 18 are metallized layers, such as, for example, copper or silver. The ground plane and the radiator pattern are bonded or adhered to their respective glass plates, and they may be formed on the glass plates by any suitable or convenient process, including mirror metallized techniques, silk screening or other printed circuit techniques, or decal transfer techniques.

The antenna of the present invention also has an annular glass edge border 26 between the plates 12 and 16 and around the entire edge periphery of plates 12 and 16. This annular glass edge element 26 serves both to maintain glass plates 12 and 16 spaced apart from each other and also hermetically seal the interior space 28 defined between glass plates 12 and 16. The border strip 26 is bonded to the plates 12 and 16 by glass solder or other appropriate glass adhesives, and the coefficients of thermal expansion of glass plates 12 and 16 and border strip 26 are matched to prevent the generation of thermal stress which might lead to cracking of the structure or separation of the bonded elements. An annular ring of lossy material, such as PTFE or epoxy resin, filled with carbon, low conductive metals such as lead, or other lossy material may be placed at the outer periphery of space 28 inside glass border 26.

A coaxial cable 30 is connected to the antenna. One conductor 32 (the outer conductor) of the coaxial cable is connected to the ground plane 14, by conductive pins 33 which pass through glass plate 12. The other conductor 34 (the inner or center conductor) of the coaxial cable projects into and is centrally positioned in space 28, but it is not connected to metal pattern 18. Conductor 34 constitutes a launch electrode for circular waves in the dielectric (air, inert gas or vacuum) of space 28. An appropriate seal 36 is provided where the coaxial cable passes through plate 14 to maintain air space 28 as a hermetically sealed space. It will be understood that coaxial cable 30 and its connections to the ground plane and feeder are shown schematically and by way of illustration only. Any suitable connection arrangement may be used.

For the TVRO antenna application primarily envisioned for the present invention, the structure will be relatively large, such as on the order of a circle 30 to 40 inches in diameter. It is important for proper signal reception and the maintaining of consistent picture quality in the television set to which the antenna is connected that the spatial relationship between the microwave components remain constant. Movement of the glass plates 12 and 16 and their respective microwave circuit components relative to each other will have adverse effects. Such movement might be caused by forces (e.g. wind, loads) acting on plate 16 or by sagging of plate 16 relative to plate 12. To maintain the proper spacing between plates 12 and 16, glass spacer elements 38 may be located between the plates and may be bonded to the plates.

In the operation of the microwave antenna of the present invention, metal surface 18 and ground plane 14 constitute a parallel plate waveguide. The apertures 20 constitute radiator sites or elements to scatter or couple microwave energy to free space. Radiators 20 are arrayed and configured to provide a radiated beam having desired polarization, beam width and other beam characteristics and parameters as desired.

Radiator apertures 20 are shown by way of illustration only. No attempt has been made to show a particular configuration of individual radiators or any particulr array. Those details will depend on various parameters of any given antenna installation and characteristics of beam to be transmitted (or received).

A microwave signal in coaxial line 30 is converted or undergoes transition to circular waves radiating in all directions from launch electrode 34. As a wave passes any radiator aperture 20, a fraction of the wave energy is radiated or coupled to space. The orientation of a radiator aperture will determine the fraction of energy radiated, and the radial distance of the radiator aperture from electrode 34 will determine the phase of the radiated wave. Thus, with an understanding of these factors which determine the characteristics of a radiated wave, an array of oriented raditors can be arranged at a series of radial distances from the electrode 34 by wave length increments to provide a polarized wave form in space that has a narrow beam. The distribution of radiation intensity over the beam aperture is controlled by spacing, size and shape of the radiators. Ideally, the radiation or scattering fractions would be designed so that very little wave energy remains in the dielectric space 28 by the time the outer edge 26 is reached. Lossy ring 29 will absorb or dissipate unradiated energy to prevent undesired reflections. Glass plate 16 should, ideally, have a thickness of approximately ½ wavelength in the glass at the center frequency of the signal being transmitted or received (12 to 14 GHz for the stationary OTS satellite now in operation). However, that ideal configuration would likely make the antenna too heavy. Therefore, glass plate 16 may be of the order of 1/10th inch thick to reduce weight. This dimensioning will result in some reflective losses but will still make the antenna an acceptable unit. As previously indicated, space 28 between glass plates 12 and 16 is preferrably an air space, with the air serving as a suitable dielectric. However, space 28 may also be filled with inert gas or be a vacuum. Also, while it is preferred that plates 12 and 16 be glass, they may be other rigid dielectric materials as long as plate 16 has a dielectric constant of 8 or less and a loss tangent of 0.01 or less; and plate 12 may be a metal or metallized surface.

While the antenna of the present invention has, for purposes of convenience, been described in terms of transmitter operation, it will be understood, as indicated above, that it will operate as a receiver antenna in reciprocal fashion with the radiator apertures acting as receiver radiator sites. Indeed, the principal use envisioned for the antenna of the present invention is as a receiver for satellite transmitted microwave signals in a home TV system. Such an antenna constructed in accordance with the present invention will be particularly effective, practical and economical. The antenna is dimensionally stable, and, hence, it may be mounted on the exterior of buildings (such as roofs of houses or other similar structures), and it may be mounted in rotatable structure for directional alignment without impairing reception of the transmitted signal, and hence the consistancy of the picture displayed on the TV screen to which the antenna is connected.

A particularly important and useful feature for outdoor antennas is that the antenna is protected from the weather by the overall hermetically sealed structure of the antenna, and the upper plate 16 protects the radiator pattern from the weather. Thus, the antenna will last for many years of outdoor use.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A parallel plate waveguide antenna including:

a first glass plate;

conductive means on one surface of said first plate defining a ground plane for a parallel plate waveguide antenna;

a second glass plate spaced from said first plate and substantially parallel thereto;

conductive coating means on one surface of said second plate means having a plurality of radiating apertures in a predetermined pattern;

said conductive means and said conductive coating means being on interior facing surfaces of the first and second plates;

spacer means for maintaining said first and second plates in spaced apart relation and defining a space between said plates; and microwave transmission means having a first conductor connected to said ground plane and a second conductor extending into said space between said first and second plates to serve as a launch electrode.

2. A parallel plate waveguide antenna as in claim 1 wherein:

said second plate has a dielectric constant of not more than 8 and a loss tangent of not more than 0.01.

3. A parallel plate waveguide antenna as in claim 1 wherein:

said second plate has a thickness of between approximately 0.1 inches to one half the wavelength in the plate of a microwave signal being received by the antenna.

4. A parallel plate waveguide antenna as in claim 1 wherein:

the coefficients of thermal expansion of said first and second plate and said spacer means are matched.

5. A parallel plate waveguide antenna as in claim 1 wherein:

said space between said plates is sealed.

6. A parallel plate waveguide antenna as in claim 5 wherein:

said space between said plates contains air.

7. A parallel plate waveguide antenna as in claim 5 wherein:

said space between said plates contains an inert gas.

8. A parallel plate waveguide antenna as in claim 5 wherein:

said space between said plates is evacuated.

9. A parallel plate waveguide antenna as in claim 1 wherein:

said second plate has a thickness of between approximately 0.1 inches to one half the wavelength in the plate of a microwave signal being received by the antenna.

10. A parallel plate waveguide antenna as in claim 1 wherein:

said space between said plates is sealed.

11. A parallel plate waveguide antenna as in claim 10 wherein:

said space between said plates contains air.

12. A parallel plate waveguide antennas as in claim 10 wherein:

said space between said plates contains an inert gas.

13. A parallel plate waveguide antenna as in claim 10 wherein:

said space between said plates is evacuated.

14. A parallel plate waveguide antenna as in claim 1 wherein:

the coefficients of thermal expansion of said first and second plate and said spacer means are matched.

15. A parallel plate waveguide antenna as in claim 1 including:

energy absorption means at the outer periphery of said space to prevent wave reflection.

16. A parallel plate waveguide antenna as in claim 15 wherein:

said energy absorption means is a ring of lossy material.

17. A parallel plate waveguide antenna as in claim 1 wherein:

said coating means is a metallic coating with a plurality of radiating slots or apertures.

* * * * *